US006485100B1

(12) United States Patent
Hitt

(10) Patent No.: US 6,485,100 B1
(45) Date of Patent: Nov. 26, 2002

(54) OUTDOOR CHAIR COVER

(76) Inventor: Marion M. Hitt, 1004 Nancy Ave., Springfield, OR (US) 97477

( * ) Notice: Subject to any disclaimer, the term of this patent is extended or adjusted under 35 U.S.C. 154(b) by 0 days.

(21) Appl. No.: 10/027,324

(22) Filed: Dec. 21, 2001

(51) Int. Cl.[7] ..... A47C 31/00
(52) U.S. Cl. ..... 297/228.13; 297/219.1
(58) Field of Search ..... 297/219.1, 224, 297/228.11, 228.12, 228.13, DIG. 1, DIG. 6, 250.1, 440.11, 440.1, 230.11, 230.1, 232, 233, 219.12; 5/632, 652, 653, 655.9

(56) References Cited

U.S. PATENT DOCUMENTS

| | | | | |
|---|---|---|---|---|
| 2,237,057 | A | * | 4/1941 | Meyer |
| 3,220,767 | A | * | 11/1965 | Hendrickson |
| 4,597,605 | A | | 7/1986 | Gilbert |
| 4,697,847 | A | | 10/1987 | Herschlag |
| D293,282 | S | | 12/1987 | Ashford |
| 4,718,721 | A | | 1/1988 | Pompa |
| 4,824,169 | A | | 4/1989 | Jarrell |
| 4,863,003 | A | | 9/1989 | Carter |
| D312,741 | S | | 12/1990 | Treadwell |
| 5,123,699 | A | * | 6/1992 | Warburton |
| 5,265,292 | A | | 11/1993 | Underell |
| 5,297,848 | A | | 3/1994 | Grinnell |
| 5,384,923 | A | | 1/1995 | Hwang et al. |
| 5,588,749 | A | | 12/1996 | Ishikawa |
| 5,641,199 | A | | 6/1997 | Bond-Madsen |
| 5,642,917 | A | * | 7/1997 | Geiger |
| D398,802 | S | | 9/1998 | Quinn |
| D413,037 | S | | 8/1999 | Bellington |
| 5,957,528 | A | | 9/1999 | Campbell |
| D417,984 | S | | 12/1999 | Sand |
| 6,135,635 | A | | 10/2000 | Miller et al. |

* cited by examiner

*Primary Examiner*—Milton Nelson, Jr.
(74) *Attorney, Agent, or Firm*—Robert E. Howard

(57) ABSTRACT

A seat cover for an outdoor chair. The seat cover includes a seat panel, back panel, and right and left side panels hingedly attached to each other. Each of the panels includes an outer washable fabric cover and an inner flexible foam core. The back panel has a strap that fits over the back of a chair. The side panels have straps with releasable fastener elements, the straps being adapted to be pulled around an adjacent structural member of the chair to the backside of the chair and releasably attach to a mating releasable fastener element located on the back side of the back panel. Each of the side panels have straps with releasable fastener elements adapted to stretch around the adjacent arm of the chair and releasably attach to a mating releasable fastener element located on the side panel.

2 Claims, 2 Drawing Sheets

OUTDOOR CHAIR COVER

BACKGROUND OF THE INVENTION

The present invention relates to an outdoor chair cover.

One of the most enjoyable parts of camping in cool weather is sitting around a campfire. Outdoor chairs of many types are used, but a common problem with all of them is that while the front of a person seated in the chair is warm, the back of the person facing away from the fire can be very cold.

Although a variety of cushion structures have been suggested for use with outdoor chairs, such cushion structures are primarily intended to provide pressure comfort padding between the chair and the posterior and back of a person sitting in the chair.

SUMMARY OF THE PRESENT INVENTION

It is an object of the present invention to provide a thermally insulated chair cover that substantially envelopes the trunk of a person sitting in the chair.

The seat cover of the present invention includes a seat panel, back panel, and right and left side panels hingedly attached to each other. Each of the panels includes an outer washable fabric cover and an inner flexible foam core. The back panel has a strap that fits over the back of a chair. The side panels have straps with releasable fastener elements, the straps being adapted to be pulled around an adjacent structural member of the chair to the backside of the back panel and releasably attach to a mating releasable fastener element located on the back side of the back panel. Each of the side panels have straps with releasable fastener elements adapted to stretch around the adjacent arm of the chair and releasably attach to a mating releasable fastener element located on the side panel.

DESCRIPTION OF THE PREFERRED EMBODIMENTS

Figure 1:
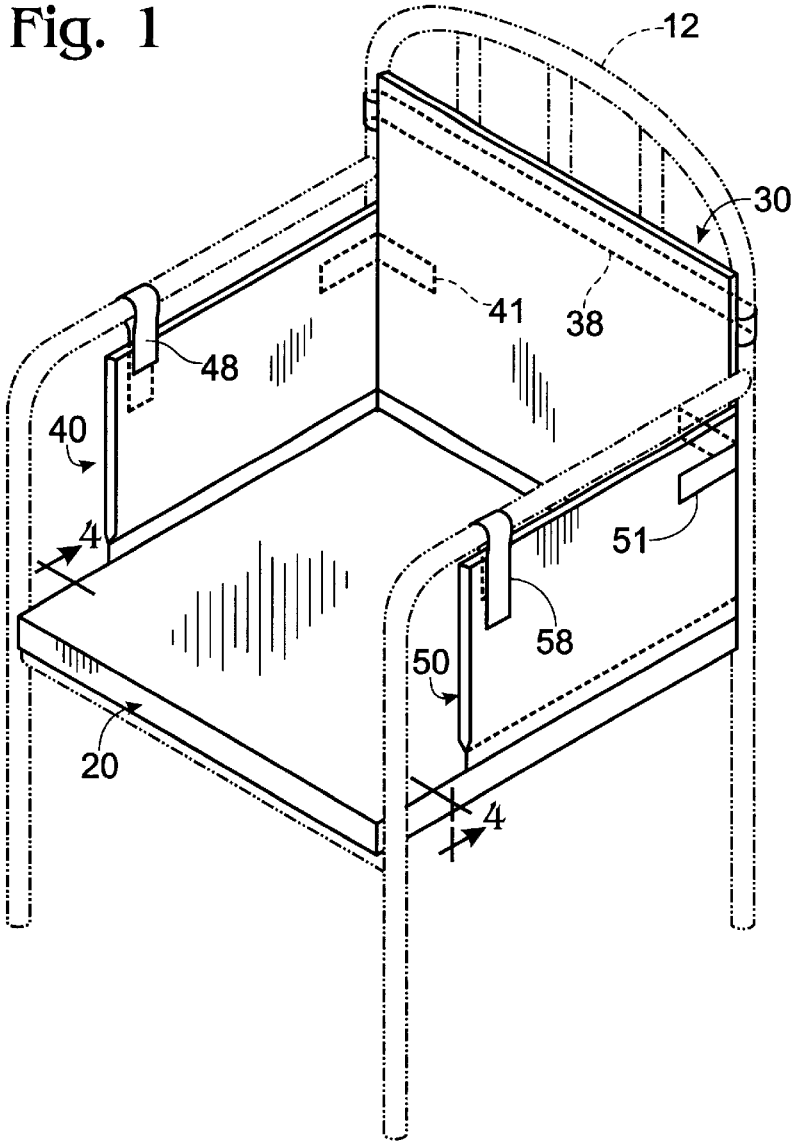
FIG. 1 is a left, front perspective view of the chair cover of the present invention shown in place on a chair shown in phantom outline.

The chair cover 10 of the present invention includes a seat (bottom) panel 20, a back panel 30, a right side panel 40 and a left side panel 50.

Herein, whenever "front" is used it is intended to mean the side which a user's body would contact, and "back" is intended to mean the side opposite the front side. "Right" and "left" are intended to mean those parts adjacent the right or left side, respectively, of a chair in which the chair cover 10 is placed for use. "Upper" and "lower" are intended to mean those parts adjacent the upper and lower part, respectively, of a chair in which chair cover 10 is placed.

Figure 4:
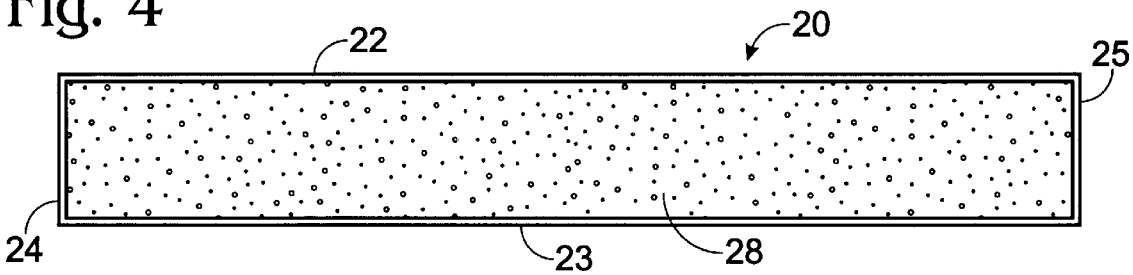
FIG. 4 is a cross-section view taken through the bottom panel of the chair cover of the present invention.
Figure 2:
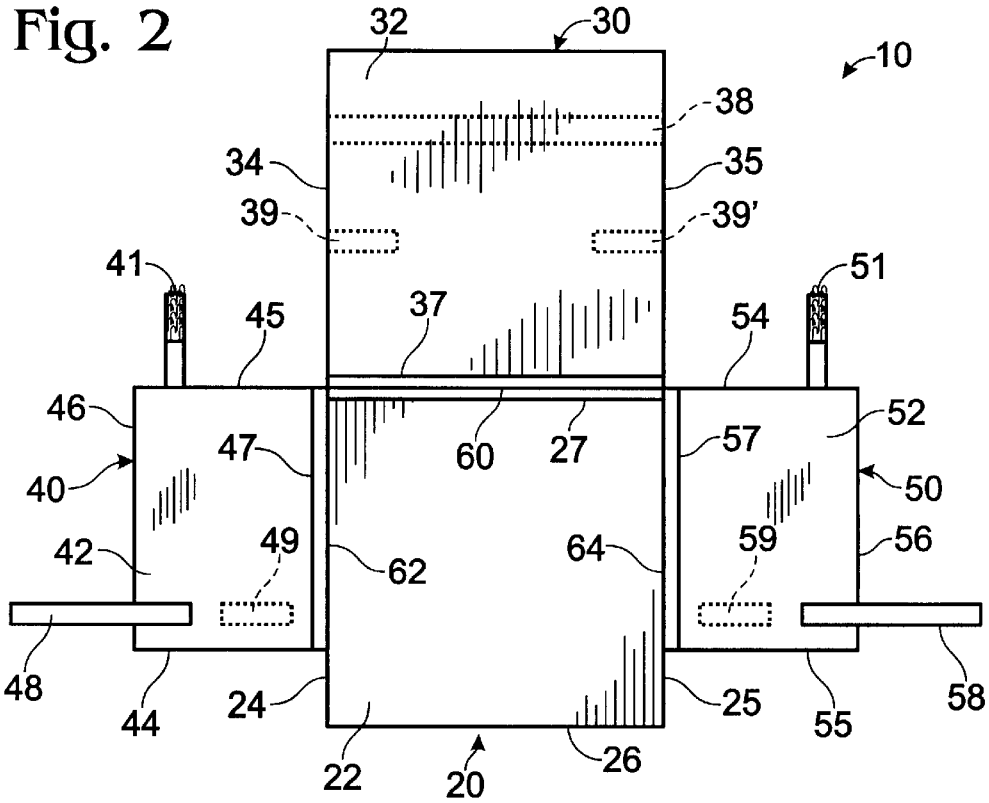
FIG. 2 is a front plan view of the chair cover of the present invention.
Figure 3:
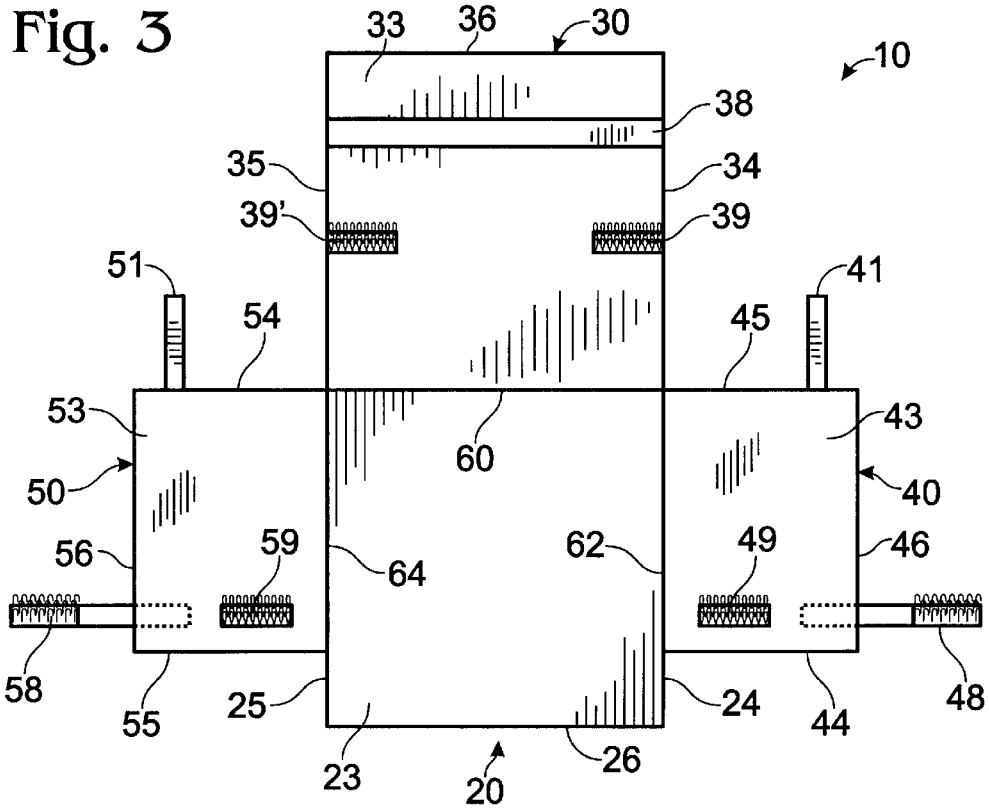
FIG. 3 is a back plan view of the chair cover of the present invention.

Seat panel 20 is comprised of front and back layers 22 and 23, respectively, of washable fabric. Front and back layers 22 and 23 are attached along right and left edges 24 and 25, and bottom edge 26, such as by stitching. Top edge 27 of front layer 22 is not attached to back layer 23 to thereby form a slipcase, and provide an opening for inserting and removing a flexible foam core 28, as best seen in FIG. 4.

Back panel 30 is comprised of front and back layers 32 and 33, respectively, of washable fabric. Front and back layers 32 and 33 are attached along right and left edges 34 and 35, and bottom edge 36, such as by stitching. Top edge 37 of front layer 32 is not attached to back layer 33 to thereby form a slipcase, and provide an opening for inserting and removing a flexible foam panel (not shown) in a manner identical to seat panel 20.

Right side panel 40 is comprised of front and back layers 42 and 43, respectively, of washable fabric. Front and back layers 42 and 43 are attached along right and left edges 44 and 45, and bottom edge 46, such as by stitching. Top edge 47 of front layer 42 is not attached to back layer 43 to thereby form a slipcase, and provide an opening for inserting and removing a flexible foam panel (not shown) in a manner identical to seat panel 20.

Left side panel 50 is comprised of front and back layers 52 and 53, respectively, of washable fabric. Front and back layers 52 and 53 are attached along right and left edges 54 and 55, and bottom edge 56, such as by stitching. Top edge 57 of front layer 52 is not attached to back layer 53 to thereby form a slipcase, and provide an opening for inserting and removing a flexible foam panel (not shown) in a manner identical to seat panel 20.

A back strap 38 extends from left to right edges 34 and 35, respectively, of back panel 30. Back strap 38 is attached at its ends to edges 34 and 35, such as by stitching. Back strap 38 is preferably made of an elastic material.

Hook or loop fastener element strips 39 and 39' are attached to the back of back panel 30, adjacent side edges 34 and 35, respectively, such as by stitching.

Hook or loop fastener element strip 41 is attached to left edge 45 of right side panel 40, such as by stitching. The hook or loop fastener element of strip 41 is selected to releasably engage the hook or loop fastener element strip 39.

Hook or loop fastener element strip 51 is attached to left edge 54 of right side panel 50, such as by stitching. The hook or loop fastener element of strip 51 is selected to releasably engage the hook or loop fastener element strip 39'.

Hook or loop fastener element strip 48 is attached to the inner side of right side panel 40 adjacent right edge 44, such as by stitching. Strip 48 extends beyond bottom edge 46 of right side panel 40, as shown. A hook or loop fastener element strip 49 is attached to the outer side of right side panel 40 adjacent right edge 44, such as by stitching. The hook or loop fastener element of strip 48 is selected to releasably engage the hook or loop fastener element strip 49.

Hook or loop fastener element strip 58 is attached to the inner side of left side panel 50 adjacent left edge 55, such as by stitching. Strip 58 extends beyond bottom edge 56 of right side panel 50, as shown. A hook or loop fastener element strip 59 is attached to the outer side of left side panel 50 adjacent left edge 55, such as by stitching. The hook or loop fastener element of strip 58 is selected to releasably engage the hook or loop fastener element strip 59.

The back layers 23, 33, 43 and 53 of panels 20, 30, 40 and 50 are hingedly attached to each other adjacent top edges 27, 37, 47 and 57. Thus, seat panel 20 is hingedly attached to rear panel 30 along attachment line 60, hingedly attached to right panel 40 along attachment line 62 and hingedly attached to left panel 50 along attachment line 64. Preferably, the back layers 23, 33, 43 and 53 of panels 20,

30, 40 and 50 are integral along attachment lines 60, 62 and 64, such as by forming from a single piece of washable fabric. However, panels 20, 30, 40 and 50 may be hingedly joined along attachment lines 60, 62 and 64 by other means, such as by stitching.

In use, chair cover 10 is placed on a chair 12 (shown in phantom outline in FIG. 1) with the seat panel 20 in abutment with the seat of the chair, back panel 30 in abutment with the back of the chair, right side panel in abutment with the right side of the chair and left side panel in abutment with the left side of the chair. In placing chair cover 10 on chair 12, strap 38 of back panel 30 is placed over the back of the chair to help hold chair cover 10 in place. Hook or loop fastener strip 41 is pulled around to the backside of back panel 30 and attached to hook or loop fastener strip 39. Similarly, hook or loop fastener strip 51 is pulled around to the backside of back panel 30 and attached to hook or loop fastener strip 391. Hook or loop fastener strip 48 is stretched up over the right arm of chair 12 and attached to hook or loop fastener strip 49. Hook or loop fastener strip 58 is stretched up over the left arm of chair 12 and attached to hook or loop fastener strip 59.

The flexible foam cores inserted into panels 20, 30, 40 and 50 provide both comfort and insulation for keeping the user warm on his or her backside. Their removability allows the washable fabric forming panels 20, 30, 40 and 50 to be washed.

When use of chair cover 10 is finished, it is removed from chair 12, right and left side panels 40 and 50 folded inwardly into abutment with seat panel 20 and with bottom edges 46 and 56 adjacent each other. Back panel 30 is then folded down into abutment with right and left side panels 40 and 50 to provide a compact construction having a length and width substantially identical to the length and width of seat panel 30 and a thickness substantially the aggregate thickness of seat panel 20, side panel 40 or 50, and back panel 30.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A chair cover comprising:

a seat panel, a back panel and right and left side panels, each of said panels having a top edge, bottom edge, right side edge and left side edge, each of said panels including front and back layers of a washable fabric, said front and back layers being attached along the bottom edge, right side edge and left side edge of each of said panels to form a slipcase, each of said panels including a flexible foam core located within its respective slipcase between its respective front and back layers of washable fabric;

said back layers of said seat panel and said back panel being hingedly attached to each other adjacent the top edges thereof;

said back layer of said seat panel being hingedly attached at its right edge adjacent the top edge thereof to the back layer of said right side panel adjacent the top edge of said right side panel, and said back layer of said seat panel being hingedly attached at its left edge adjacent the top edge thereof to the back layer of said left side panel adjacent the top edge of said left side panel;

said back panel including a strap on said back layer thereof adapted to fit over the back of a chair, and further including right and left releasable fastener elements located adjacent each of said right and left side edges in a mid-portion of said back panel;

each of said right and left side panels including a first strap extending upwardly from their respective left and right side edge, said first strap including a first releasable fastener element, said first releasable fastener element of said right side panel adapted to releasably engage said right releasable fastener element of said back panel, and said first releasable fastener element of said left side panel adapted to releasably engage said left releasable fastener element of said back panel;

each of said right and left side panels further including a second strap extending outwardly from their bottom edge, each of said second straps including a second releasable fastener element, a third releasable fastener element attached to each of said right and left side panels, said second releasable fastener element of each of said right and left side panels adapted to stretch around an arm of a chair and releasably engage said third releasable fastener element of said right and left side panels.

2. The chair cover of claim 1 wherein said front and back layers of washable fabric along the top edge of each of said seat panel, back panel and right and left side panels are not attached and adapted to allow said flexible foam core to be inserted into and removed from each of said respective slipcases.

* * * * *